US007306194B2

(12) United States Patent
Grote et al.

(10) Patent No.: US 7,306,194 B2
(45) Date of Patent: Dec. 11, 2007

(54) MOLD FOR PRODUCING A CERAMIC HEAT SHIELD ELEMENT

(75) Inventors: Holger Grote, Bonn (DE); Andreas Heilos, Mülheim an der Ruhr (DE); Marc Tertilt, Hattingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/482,642

(22) Filed: Jul. 7, 2006

(65) Prior Publication Data

US 2007/0007426 A1 Jan. 11, 2007

(30) Foreign Application Priority Data

Jul. 7, 2005 (EP) ..... 05014798

(51) Int. Cl.
*B28B 7/16* (2006.01)

(52) U.S. Cl. ..... 249/160; 249/84; 249/97; 249/167

(58) Field of Classification Search ..... 249/102, 249/105, 129, 131, 168, 169, 117, 88, 91, 249/160, 163, 167, 155, 84, 97; 425/130; 65/374.13, 265; 264/40.6, 328.16
See application file for complete search history.

(56) References Cited

U.S. PATENT DOCUMENTS

| | | | | |
|---|---|---|---|---|
| 793,067 | A * | 6/1905 | Haggenjos | 164/359 |
| 824,235 | A * | 6/1906 | Damon | 249/129 |
| 1,104,926 | A * | 7/1914 | Pettis | 249/95 |
| 1,131,840 | A * | 3/1915 | Hunt | 249/125 |
| 1,468,702 | A * | 9/1923 | Dunn | 249/129 |
| 1,476,684 | A * | 12/1923 | Black et al. | 249/146 |
| 2,359,214 | A * | 9/1944 | George | 249/85 |
| 2,425,137 | A * | 8/1947 | Troiel | 249/181 |
| 3,538,550 | A * | 11/1970 | Durrwachter et al. | 425/78 |
| 3,865,529 | A * | 2/1975 | Guzzo | 425/556 |
| 4,239,176 | A * | 12/1980 | Salazar | 249/97 |
| 6,328,552 | B1 * | 12/2001 | Hendrickson et al. | 425/188 |
| 2003/0164574 | A1 * | 9/2003 | Hammer et al. | 264/162 |

FOREIGN PATENT DOCUMENTS

| | | |
|---|---|---|
| EP | 0 558 540 B1 | 9/1993 |
| EP | 1 508 761 A1 | 2/2005 |

* cited by examiner

*Primary Examiner*—Yogendra N. Gupta
*Assistant Examiner*—Dimple N. Bodawala

(57) ABSTRACT

A mold for producing a ceramic heat shield element having a mold shell is provided. The mold shell comprises a plurality of mold surfaces and a casting aperture for pouring in a ceramic material. The mold shell is embodied as a single-piece mold shell during casting, and the casting aperture is embodied as an aperture in one of the mold surfaces. Separating or retaining elements enable graded or reinforced heat shield elements to be produced.

10 Claims, 8 Drawing Sheets

MOLD FOR PRODUCING A CERAMIC HEAT SHIELD ELEMENT

CROSS REFERENCE TO RELATED APPLICATIONS

This application claims the benefits of European Patent application No. 05014798.2 filed Jul. 7, 2005 and is incorporated by reference herein in its entirety.

FIELD OF THE INVENTION

The present invention relates to a mold for producing a ceramic heat shield element.

BACKGROUND OF THE INVENTION

The walls of hot gas conducting combustion chambers, of gas turbine plants for example, require their supporting structure to be thermally shielded against attack by hot gas. The thermal shielding can be implemented for example by means of a hot gas lining disposed in front of the actual combustion chamber wall, in the form of a ceramic heat shield for example. A hot gas lining of said kind is usually constructed from a number of ceramic heat shield elements with which the combustion chamber wall is lined over its surface area. Ceramic materials are ideally suited for constructing the hot gas lining compared with metallic materials on account of their high temperature resistance, corrosion resistance and low thermal conductivity. A ceramic heat shield is described for example in EP 0 558 540 B1. In particular a heat shield element can comprise a core zone and an edge zone, the thermal conductivity of the material in the edge zone being less than in the core zone. A heat shield element of said kind is described in EP 1 508 761 A1.

SUMMARY OF THE INVENTION

Currently it is customary to manufacture ceramic heat shield elements by casting or compression molding. In order to illustrate the casting or compression-molding process, a heat shield element and a mold for producing said heat shield element will be described below with reference to FIGS. 1 to 3.

The ceramic heat shield element 100 shown in FIG. 1 has a hot side 102 which faces toward the hot gas when the heat shield element 100 is installed in the heat shield of a combustion chamber. Opposite the hot side 102 is the cold side 104, which faces toward the combustion chamber wall that is to be protected when the heat shield element is installed in a heat shield. Also present are peripheral sides 106, 108 which extend between the hot side 102 and the cold side 104. Two peripheral sides 108 opposite each other are also provided with grooves 110 which serve to fix the heat shield element 100 in place on the supporting wall structure by means of retaining elements.

FIG. 2 shows in a perspective representation a compression mold 200 for producing the heat shield element from FIG. 1. The mold 200 consists of a number of molded parts 202*a* to 202*e* which are inserted into a molding box 203 and held in position by the latter. The internal surfaces 204, 206, 208 of the molded parts 202*a* to 202*e* represent the mold surfaces for molding the surface of the heat shield element 100. Thus, for example, the internal surface 204 serves for molding the cold side 104 of the heat shield element, the internal surfaces 206 for molding the side areas 106 without groove, and the internal surfaces 208 for molding the side areas 108 with groove 110. The internal surfaces 208 have spring-like projections 210 for shaping the grooves 110.

In order to produce the ceramic heat shield element 100, a ceramic molding compound 220 is introduced into the mold 200 with the installed molded parts 202*a* to 202*e* and subsequently pressed into shape by means of a die 212. In this case the surface 214 of the die 212 facing toward the molding compound 220 molds the hot gas surface 102 of the ceramic heat shield element 100. The compressive pressure necessary for compressing the molding compound 220 requires the mold 200 to be completely closed during the compression-molding process, i.e. the die 212 must be embodied as a precise fit for the mold 200. Furthermore the compressive pressure can result in a springing back of the molded parts. Variations in the material quantity of the molding compound 220 can also lead to variations in the thickness of the finished ceramic heat shield element.

As an alternative to the compression molding, the heat shield element 100 can also be cast using the mold 200, i.e. without a compression-molding operation taking place. Since the heat shield element is cast in a horizontal position, however, either the hot side 102 or the cold side 104 is not defined by the mold during the casting process. The undefined side requires a time-consuming and laborious reworking after the casting in order to produce the desired shape of the heat shield element 100.

Finally, the molds described are not suitable for producing a heat shield element which has different material zones with different material properties in a single casting or compression-molding step. The production of heat shield elements with reinforcing elements on the inside is also not possible.

It is therefore an object of the present invention to provide a mold for producing a ceramic heat shield element that is advantageous compared to the described background art.

A further object of the present invention is to provide an advantageous method for producing a ceramic heat shield element.

The first object is achieved by a mold as claimed in the claims and the second object is achieved by a method as claimed in the claims. The dependent claims contain advantageous embodiments of the invention.

An inventive mold for producing a ceramic heat shield element has a mold shell which comprises a number of mold surfaces and a casting aperture for pouring in a ceramic material. The mold shell is embodied as a single-piece mold shell during casting and the casting aperture is embodied as an opening in one of the mold surfaces. The phrase "single-piece mold shell during casting" is not to be understood in this context as indicating that the mold shell is formed monolithically from a single piece, but rather as meaning that during the pouring in of the casting compound the mold shell does not consist of two elements that are not permanently joined to each other, for example of molded parts simply inserted into a molding box and a die as described with reference to FIGS. 2, 3*a* and 3*b*. The mold according to the invention can, however, be composed of a number of individual parts provided these are tightly mated with one another during the pouring in of the molding compound. In contrast to the mold described in the introduction, with the mold according to the invention no molding box is necessary. Such a molding box impedes in particular the fabrication of graded and/or reinforced heat shield elements, since during the production of a heat shield element the molded parts are disposed inaccessibly in the interior of the molding box.

If the mold is composed of a plurality of individual parts which need to be tightly joined to one another for the casting process for forming the single-piece mold shell, easy removal of the cured heat shield element is possible by detaching the individual parts from one another.

In contrast to the mold according to the prior art, in which one side of the mold is completely missing during the casting process, in the mold according to the invention a mold surface having a casting aperture for feeding the mold is present. In other words the mold surface in which the casting aperture is present defines the corresponding surface of the heat shield element at least in a rudimentary manner. With the mold according to the invention, therefore, all surfaces of the heat shield element can be formed at least rudimentarily without the need for compression molding of the heat shield element. In this case the result of the rudimentarily present mold surface in the area of the casting aperture is that surplus casting material present in the area of the casting aperture can be removed after the curing with the aid of the rudimentary heat shield element surface formed by the mold surface as a reference surface. The removal of superfluous material and the finishing of the heat shield element are therefore possible with relatively little effort.

Moreover, when the mold according to the invention is used the dimensions of the cast heat shield element are not dependent on the amount of material poured in, since no compression molding is performed. As the mold is completely closed in the compression-molding process according to the prior art, there is no possibility of the casting material escaping from the mold. Varying amounts of casting material therefore lead to the production of heat shield elements of differing thickness. In the mold according to the invention, on the other hand, surplus casting material can escape through the casting aperture without the dimensions of the heat shield element being compromised as a result. Furthermore, no springing back of the mold under compressive pressure occurs during casting. The mold according to the invention therefore permits the production of heat shield elements with reduced tolerances.

The mold according to the invention comprises in particular mold surfaces for molding a large-area first surface and a large-area second surface as well as mold surfaces for molding small-area (compared to said first and second surfaces) peripheral surfaces which extend from the first surface to the second surface. The casting aperture is then embodied in a mold surface for molding one of the peripheral surfaces.

In a special embodiment of the mold according to the invention at least one separating element is present by means of which different areas in the interior of the mold shell can be separated from one another. The separating element is embodied and to be disposed in the mold shell in such a way that it can be removed from the interior of the mold shell again before the curing of the poured-in ceramic material, without the mold having to be opened. This embodiment enables in particular the production of graded heat shield elements, i.e. such heat shield elements that comprise at least two zones which consist of materials with different material properties.

A graded heat shield element can then be produced, for example, by introducing the inserts into the casting mold before the ceramic material is poured in, then pouring in the ceramic material, and removing the inserts again after the ceramic material has been poured in. After the inserts have been removed the different ceramic materials can come into contact with one another and so form a firmly bonded join during curing. It is also possible that the adjacent materials merge in the threshold region when the separating elements are removed, with the result that on completion of the curing a heat shield element is present in which the two materials exhibit a fluid transition into each other.

The at least one separating element can be embodied in particular as an insert for inserting into the mold shell through the casting aperture. In particular an insert can be present which separates the interior of the mold shell into an area facing toward the mold surface for molding the large-area first surface and an area facing toward the mold surface for molding the large-area second surface. This enables the production, for example, of ceramic heat shield elements in which the cold side has different material properties from the hot side, for example a different rigidity or a different coefficient of thermal expansion.

A further possibility consists in providing two inserts which separate the interior of the mold shell into a central area and into two areas which face toward opposite mold surfaces for molding peripheral surfaces of the heat shield element. With this embodiment, heat shield elements can be produced which, in the area of two peripheral sides, have different material properties than in the area lying in between, for example different coefficients of thermal expansion or a different rigidity.

In a further embodiment of the mold according to the invention, said mold can comprise at least one retaining element that is to be introduced into the interior of the mold shell. The retaining element is embodied and disposed in the mold shell in such a way that it can fix a body, for example a reinforcing element, in position in the interior of the mold shell and that it can be removed from the interior of the mold shell again before the poured-in ceramic material has cured. For example, retaining pins which can be moved from the exterior of the mold shell into the interior of the mold shell and back out again may be present as retaining elements. The retaining pins can be disposed in particular in the mold surface for molding a large-area first surface and/or in the mold surface for molding a large-area second surface.

The retaining elements enable bodies such as, for example, reinforcing elements to be held in position in the interior of the mold when the ceramic material is poured in. After the ceramic material has been poured in, the retaining elements can be removed from the interior of the mold, with the result that the body is held in position solely by the surrounding ceramic material. Following the curing the body forms a body cast into the ceramic heat shield element. In this way high-strength reinforcing elements, for example, can be incorporated into a ceramics heat shield element.

In the inventive method for producing a ceramic heat shield element, a ceramic heat shield element is produced using a casting process. In this case a mold according to the invention is used for the casting.

BRIEF DESCRIPTION OF THE DRAWINGS

Further features, characteristics and advantages of the present invention will emerge from the following description of exemplary embodiments with reference to the accompanying figures.

DETAILED DESCRIPTION OF THE INVENTION

Figure 1:
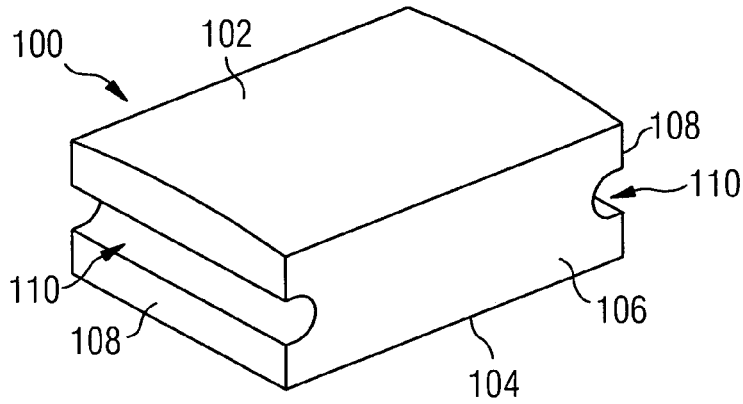
FIG. 1 shows a ceramic heat shield element in a perspective representation.
Figure 2:
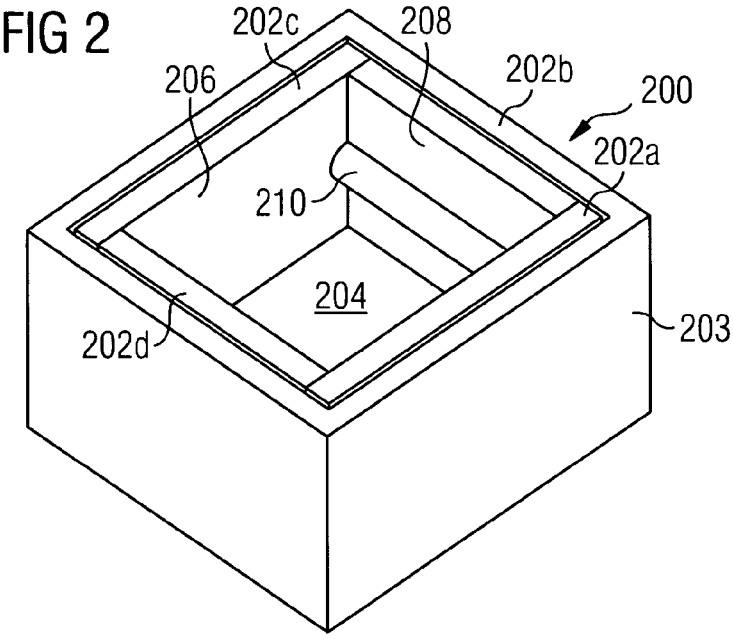
FIG. 2 shows schematically a compression mold for producing a heat shield element, as shown in FIG. 1, in a perspective representation.
Figure 3A:
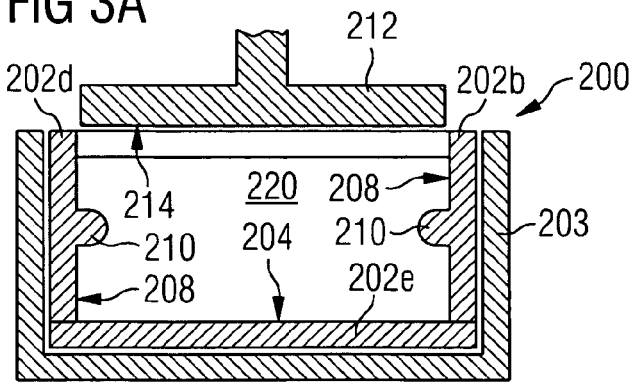
FIG. 3 shows the compression mold illustrated in FIG. 2 in a sectional side view.
Figure 3B:
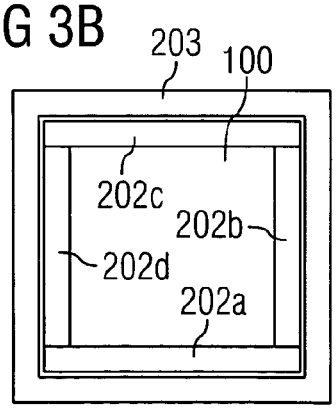
Figure 4:
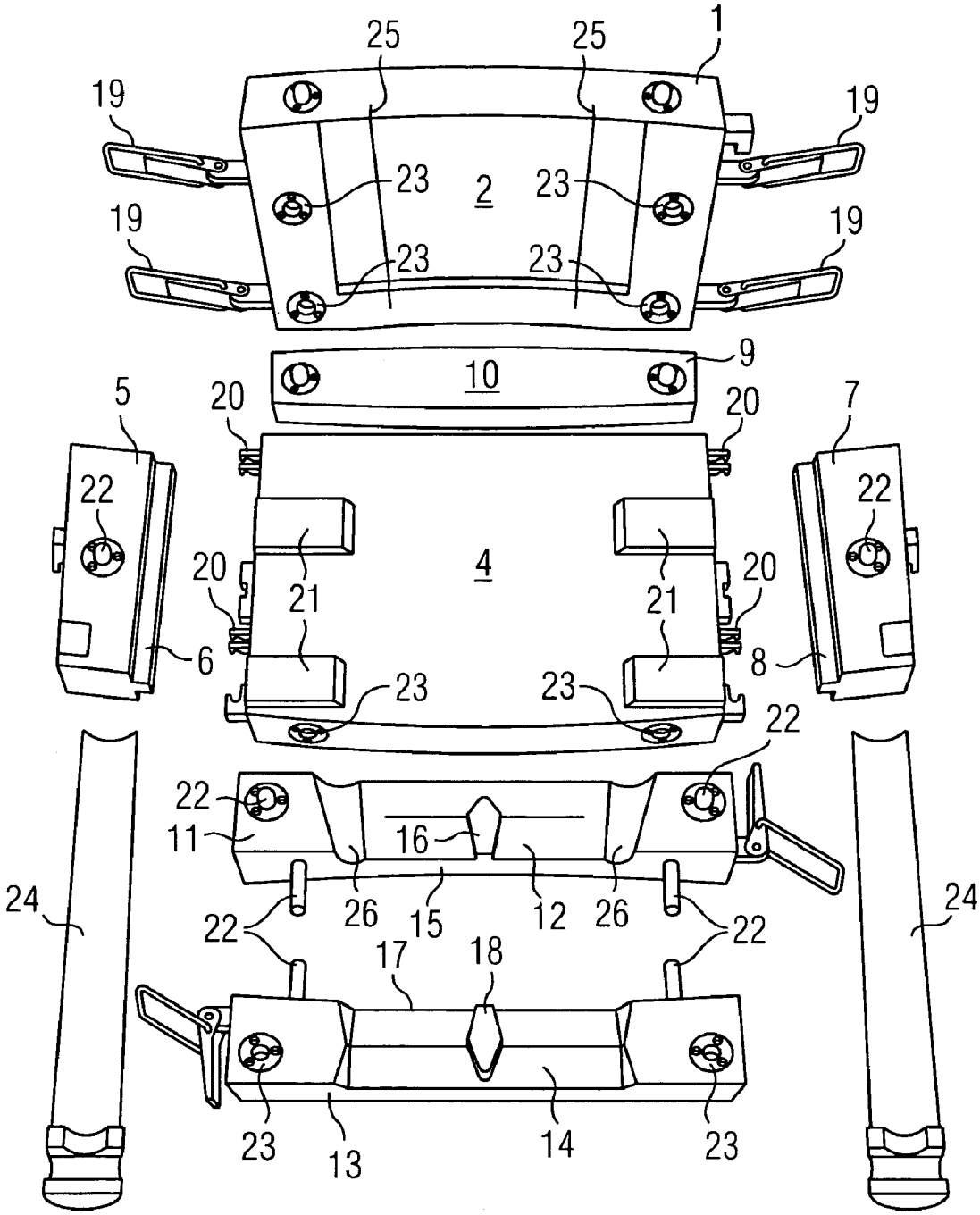
FIG. 4 shows the individual parts of a first exemplary embodiment for the mold according to the invention.

A first exemplary embodiment for an inventive mold for producing a ceramic heat shield element, as illustrated schematically in FIG. 1, is shown in FIG. 4. The figure shows the individual parts of the mold shell which are tightly yet detachably joined to one another before a ceramic material is poured in. In the present exemplary embodiment the parts are joined by means of clamp connections but they can also just as effectively be joined by means of other detachable connections, screw connections for example. Compared with screw connections, however, clamp connections have the advantage that the connection can be produced and released again without tools.

The individual parts which can be joined to the mold shell comprise the shell elements 1 and 3 which have mold surfaces 2 and 4 by means of which the hot side 102 and the cold side 104 of the heat shield element 100 are molded.

Side pieces 5 and 7 are also present, each of which has a spring-like projection 6, 8. These two individual parts form the mold surfaces for the peripheral sides 108 of the heat shield element 100, said peripheral sides 108 being provided with the grooves 110. In this arrangement the spring-like projections 6, 8 serve to shape the grooves.

The mold shell additionally comprises a bottom element 9 which serves as a mold surface 10 for molding one of the peripheral sides 106 of the heat shield element 100 without grooves. The mold stands on the bottom element 9 when the heat shield element is cast.

Finally two shell elements 11, 13 are present which are located opposite the bottom element 9 when the mold shell is assembled. The two shell elements 11, 13 are provided with set-offs 12, 14 which are disposed in such a way that after the two shell elements 11, 13 are joined together they form a casting aperture for pouring in the ceramic material. In addition, these two shell parts each have a mold surface 15, 17 by means of which edge zones of the second peripheral side 106 are molded without grooves. Also present in the recesses are webs 16, 18 by means of which the casting aperture of the assembled mold shell is subdivided into two partial apertures. If the ceramic material is poured only into the one partial aperture, air can escape from the interior of the mold shell through the other partial aperture.

Figure 9:
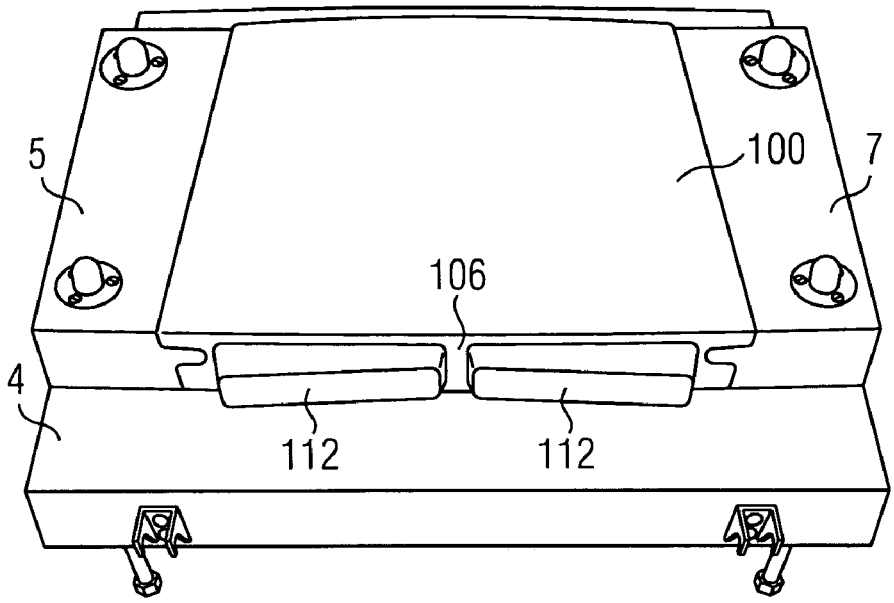
FIG. 9 shows an open mold according to the invention having a ceramic heat shield element disposed therein.

FIG. 9 shows the mold shell in the partially assembled state after the casting of a ceramic heat shield element 100. The shell parts 4, 5 and 7 from FIG. 4 can be seen. FIG. 9 shows in particular that parts of the peripheral side 106 are molded in the area of the casting aperture during the casting. Casting residues 112 on the ceramic heat shield element 100 are mechanically removed following the curing. The already shaped parts of the peripheral side 106 can be used in this case as a reference surface.

To allow the shell elements to be tightly joined to one another, the shell element 1 is equipped with four clamping elements 19 which can be brought into engagement with hooks 20 of the shell element 3 and tensioned. In order to prevent slipping of the side elements 5, 7 disposed between the shell elements 1 and 3, the bottom element 9 and the shell elements 11 and 13 forming the casting aperture during the tensioning process, mold projections 21 are present which interact positively with various mold projections or set-offs of other shell elements. Also present are pins 22 which engage in receptacles 23 of adjacent mold elements and so prevent the mold elements from shifting relative to one another.

The mold shown in FIG. 4 also comprises inserts 24 which can be introduced through the casting aperture into the interior of the mold shell in order to separate different areas in the interior of the mold shell from one another. Guide grooves 25 are present in the shell element 1 for the purpose of guiding the inserts 24 when they are introduced into the assembled mold shell. The shell element 11 also has guide recesses 26 for guiding the inserts 24.

The inserts 24 are introduced into the assembled mold shell before the casting of a heat shield element so that in its interior areas that are adjacent to the shell elements 5, 7 with the spring-like projections 6, 8 are separated from a central area. A different ceramic material is poured into the areas which are adjacent to the shell elements 5, 7 than in the central area of the mold shell. After the materials have been poured in, the inserts 24 are removed from the mold shell so that the two materials can mix with each other in the threshold region and produce a bonded join during curing. In this way graded heat shield elements can be produced.

Figure 10:
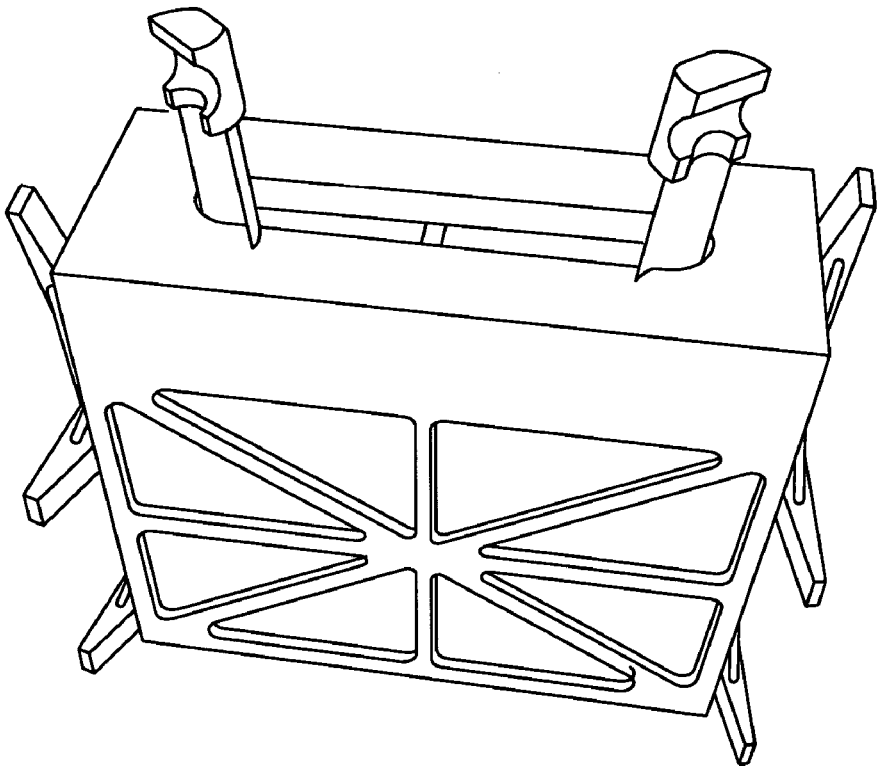
FIG. 10 shows a mold shell having inserts disposed therein for separating different areas in the interior of the mold shell.

The assembled mold shell with inserts disposed therein is shown in FIG. 10.

Figure 5:
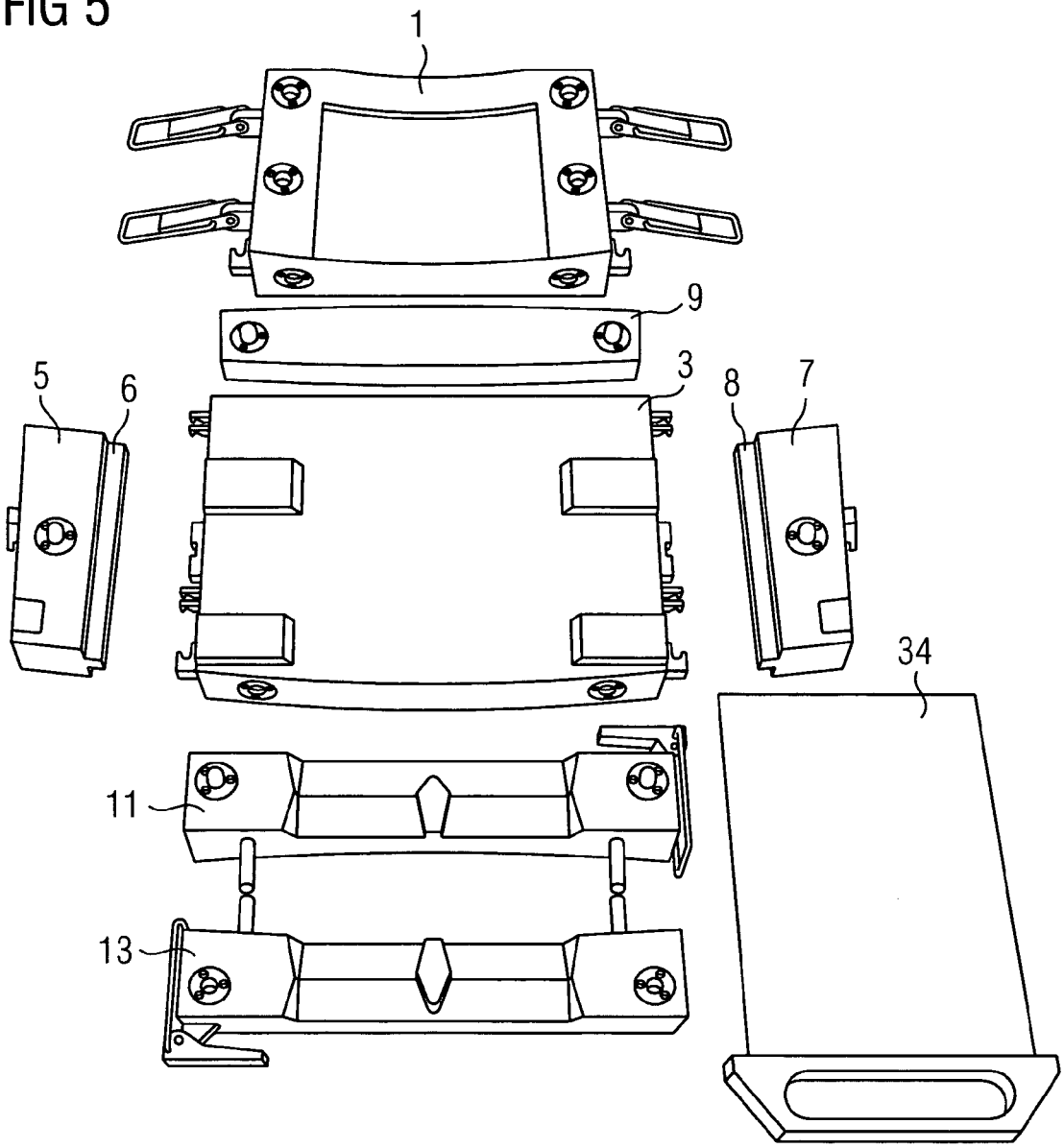
FIG. 5 shows the individual parts of a second exemplary embodiment for the mold according to the invention.

A second exemplary embodiment for the mold according to the invention is shown in FIG. 5. Like FIG. 4, FIG. 5 shows the mold shell of the mold in individual parts. In order to avoid repetitions, only the differences from the mold shown in FIG. 4 will be dealt with. The reference numerals of the shell elements shown in FIG. 5 are consistent with the reference numerals of the corresponding shell elements from FIG. 4.

In contrast to the mold shown in FIG. 4, the mold shown in FIG. 5 comprises only one insert 34, which is suitable for separating the interior of the assembled mold shell into a hot-side area, i.e. an area which adjoins the shell element 1 with the mold surface 2 for molding the hot side 102, and a cold-side area, i.e. an area which adjoins the shell element 3 with the mold surface 4 for molding the cold side 104. Accordingly, no guide grooves are present in the shell elements 1 and 11. Instead, the spring-like projections 6 and 8 have guide grooves for guiding the insert 34.

Figure 11:
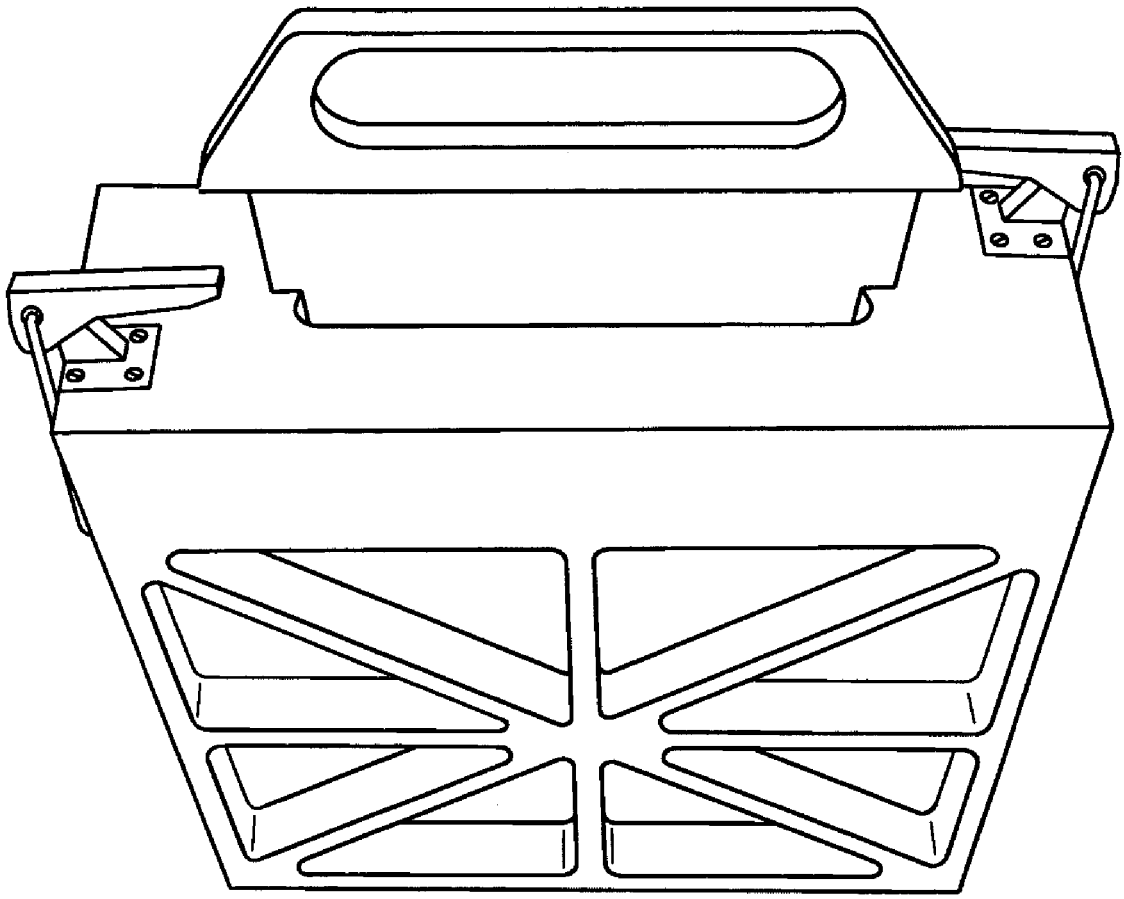
FIG. 11 shows a mold shell having an insert disposed therein for separating different areas in the interior of the mold shell.

The assembled mold shell from FIG. 5 with insert disposed therein is shown in FIG. 11.

Figure 6:
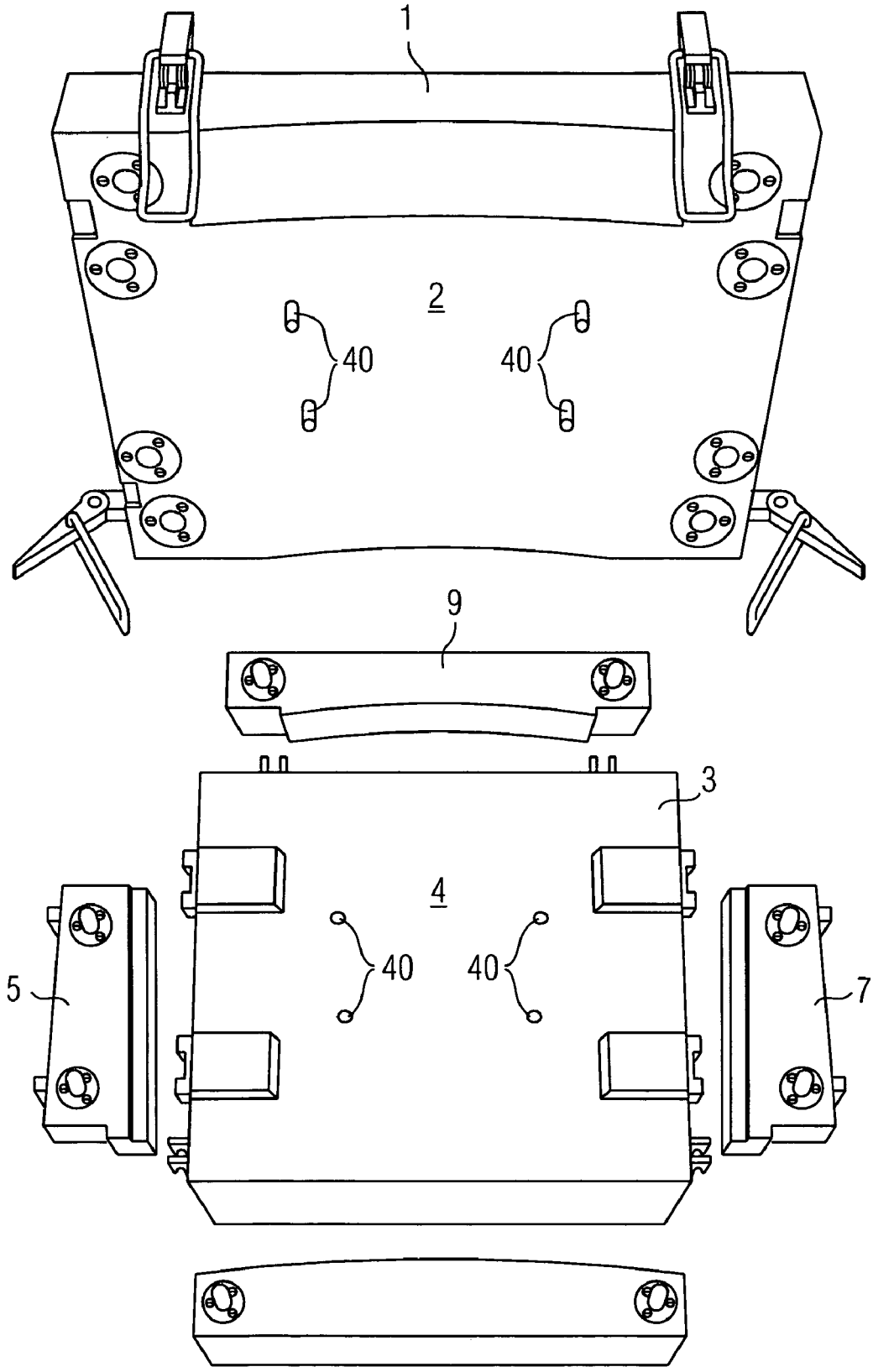
FIG. 6 shows the individual parts for a third exemplary embodiment of the mold according to the invention.

A third exemplary embodiment for the mold according to the invention is shown in FIG. 6. Like FIGS. 4 and 5, FIG. 6 shows the mold shell broken down into its individual parts. The individual parts are designated by the same reference numerals as the corresponding individual parts from FIGS. 4 and 5. In order to avoid unnecessary repetitions, only the differences from the molds shown in FIGS. 4 and 5 will be referred to at this juncture.

Figure 7:
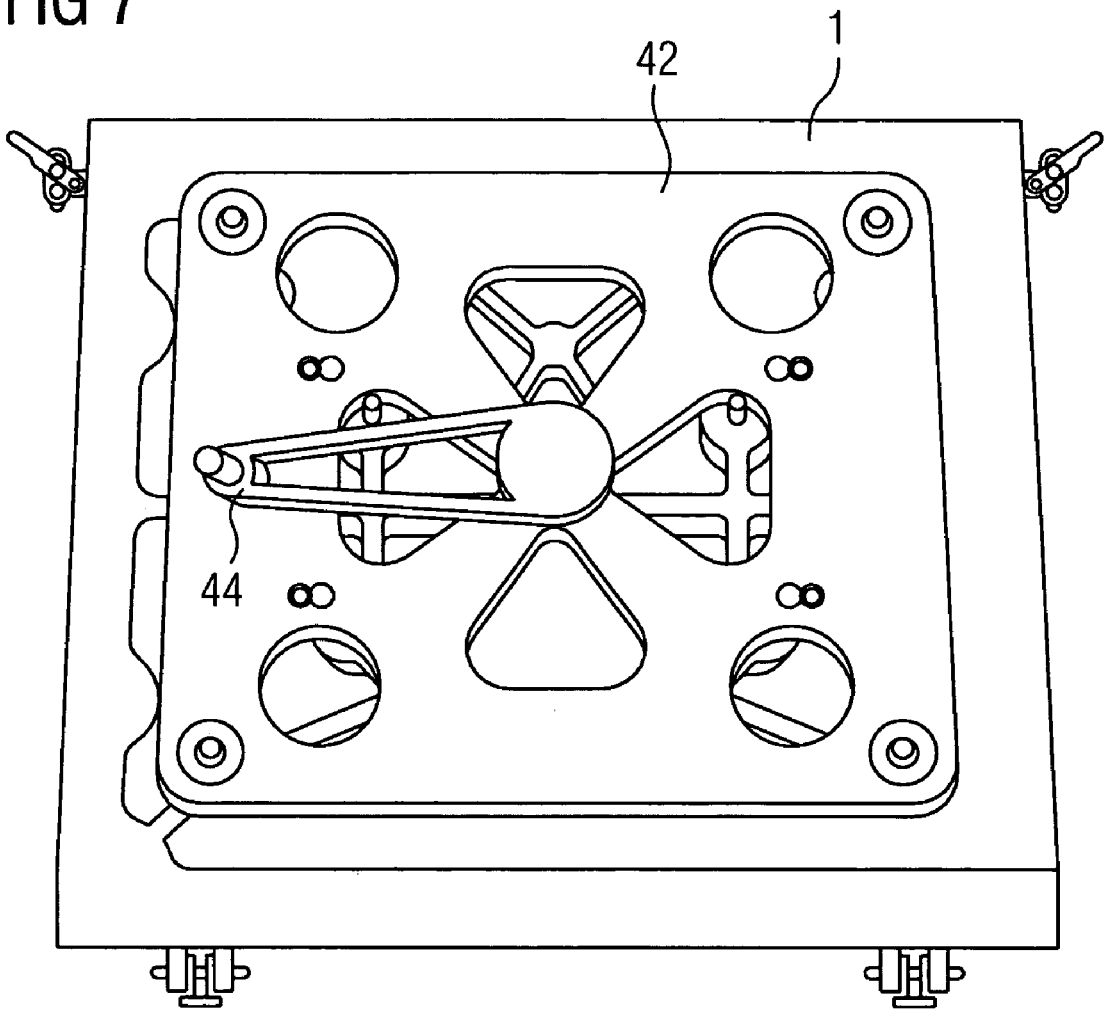
FIG. 7 shows the mold of the third exemplary embodiment in a side view.
Figure 8:
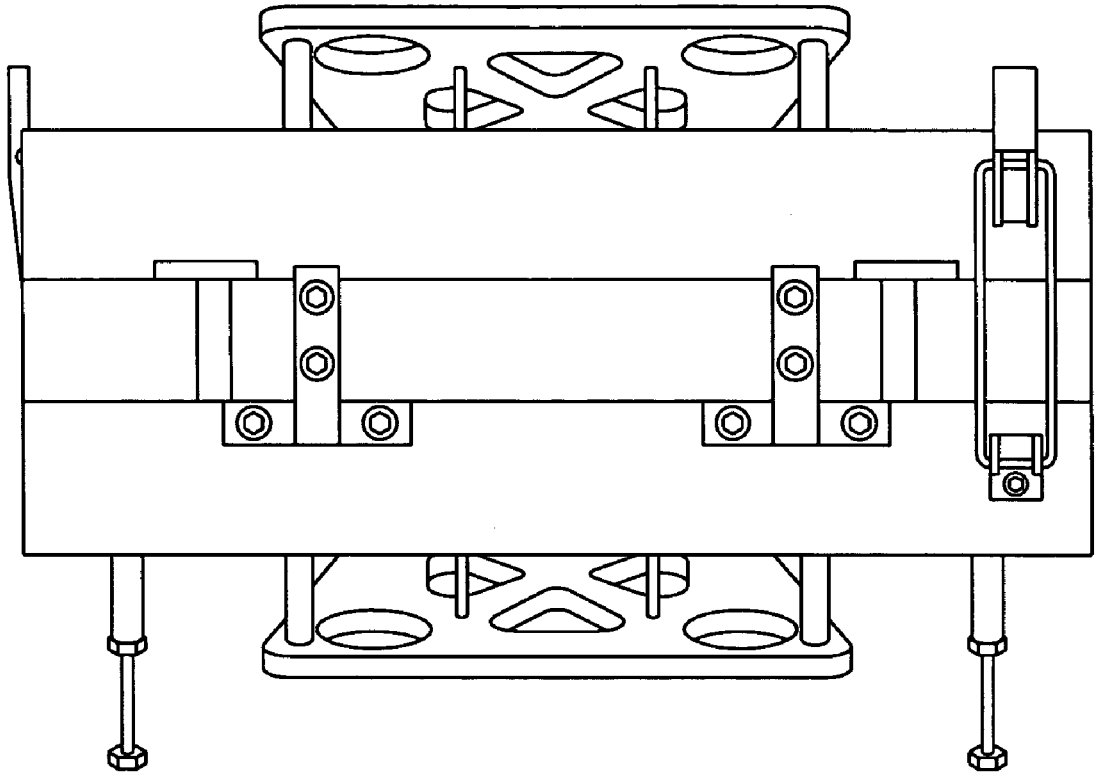
FIG. 8 shows the mold of the third exemplary embodiment in a plan view.

The mold shell from FIG. 6 is not provided for the insertion of inserts. Accordingly the shell elements also have no guide grooves for molded parts of this kind. Present instead in the shell elements 1 and 3 are retaining pins 40 which are movably arranged in such a way that with the mold shell assembled they are to be introduced from the exterior of the shell elements 1, 3 into the interior of the mold shell. For this purpose a retaining pin plate 42 carrying the retaining pins 40 is arranged on the outside of the mold shells 1, 3. The distance of said retaining pin plate from the outside of the respective shell element 1, 3 can be varied by means of a crank 44 or by means of an automated embodiment of the retaining pins. If the retaining pin plate completely abuts the outside of the shell element 1, the retaining pins 40 project to a maximum into the interior of the mold shell. This state is shown with reference to the shell element 1 in FIGS. 6 and 7. If, on the other hand, the retaining pin plate 42 is at its greatest distance from the outside of the shell element 1, the retaining pins 40 are completely countersunk in the wall of the shell element, so they no longer project into the interior of the mold shell. This state is shown in FIG. 8 and also in FIG. 6 in the case of the shell element 3.

The retaining pins 40 can be used, for example, to hold reinforcing elements in place while the ceramic material is poured into the interior of the mold shell. The holding in place can be effected, for example, simply on account of the retaining pins 40 pressing from two opposite sides against the reinforcing element and fixing the latter in place by means of the resulting friction. Alternatively it is also possible to provide openings in the reinforcing element, into which openings the retaining pins 40 can engage for the purpose of holding the reinforcing element in place.

In particular two-dimensional reinforcing elements can be introduced as reinforcing elements into the interior of the mold shell, said reinforcing elements extending for example parallel to the hot side or cold side 102, 104 of the heat shield element 100 that is to be molded. However, rod- or bone-shaped reinforcing elements can also be introduced into the interior of the mold shell, said reinforcing elements extending essentially along the length of the shell elements 5, 7, 9 which shape the peripheral sides 106, 108 of the heat shield element 100. In the finished heat shield element the reinforcing elements extend along the length of the peripheral sides 106, 108.

After the reinforcing elements have been fixed in place in the interior of the mold shell, a ceramic material is poured into the mold shell. Subsequently the retaining pins 40 are withdrawn from the interior of the mold shell by means of the crank 44 or, as the case may be, an automatic retraction device. This state is shown in FIG. 8. The reinforcing elements are then fixed in their position solely by the introduced ceramic material.

The invention claimed is:

1. A mold for producing a ceramic heat shield, comprising:

a bottom mold portion;

a top mold portion arranged opposite the bottom mold portion;

a first side mold portion arranged between the top and bottom mold portions;

a second side mold portion arranged adjacent the first side mold portion and between the top and bottom mold portions;

a third side mold portion arranged opposite the second side mold portion and between the top and bottom mold portions, and a fourth side mold portion arranged opposite the first side mold portion and between the top and bottom mold portions, wherein the fourth side mold portion comprises an upper half arranged adjacent to the top mold portion and a lower half arranged adjacent to the bottom mold portion where the upper and lower halves each contains an aperture, configured to receive an uncured, fluid ceramic material, wherein the first, second, third and fourth side mold portions comprise the peripheral surfaces of the mold shell, and are positioned to extend perpendicular relative to the top and bottom mold portions, and further wherein the first, second, third and fourth side mold portions are constructed and arranged to removably connect with the top and bottom portions.

2. The mold as claimed in claim 1, wherein the mold portions are secured together by clamps.

3. The mold as claimed in claim 1, further comprising a separating element that separates areas of an interior of the mold shell.

4. The mold as claimed in claim 3 wherein the separating element is removable from the interior of the mold shell before the fluid ceramic material has cured without requiring disassembly of the mold.

5. The mold as claimed in claim 3 wherein the separating element is an insert that is introduced into the interior of the mold shell through the casting aperture.

6. The mold as claimed in claim 5, wherein the insert separates the interior of the mold shell into an upper region and lower region.

7. The mold as claimed in claim 5, wherein a first and second inserts separate the interior of the mold shell into a central area and two additional areas that face toward opposite peripheral mold surfaces.

8. The mold as claimed in claim 1, further comprising a retaining element that locates a body in the interior of the mold shell and the element is removable from the mold without requiring disassembly of the mold.

9. The mold as claimed in claim 8, wherein the retaining element is a freely movable retaining pin that is movable into and out of the interior of the mold shell from outside the mold shell.

10. The mold as claimed in claim 9, wherein the retaining pins are arranged in the mold surface for the purpose of molding a first large-area surface or a second large-area surface.

* * * * *